US005679918A

United States Patent [19]

Korpi et al.

[11] Patent Number: 5,679,918

[45] Date of Patent: Oct. 21, 1997

[54] INTERIOR ARMOR FOR PASSENGER VEHICLES

[75] Inventors: John G. Korpi; Peter W. Pfister, both of Livonia, Mich.

[73] Assignee: The United States of America as represented by the Secretary of the Army, Washington, D.C.

[21] Appl. No.: 790,883

[22] Filed: Feb. 3, 1997

[51] Int. Cl.[6] ..... F41H 7/04

[52] U.S. Cl. ..... 89/36.08; 89/36.02; 109/49.5

[58] Field of Search ..... 89/36.08, 36.07, 89/36.02; 296/76, 152; 109/49.5

[56] References Cited

U.S. PATENT DOCUMENTS 3,855,898 12/1974 McDonald ..... 89/36.08
5,340,189 8/1994 Goodman ..... 296/152
5,438,908 8/1995 Madden, Jr. ..... 89/36.08
5,533,781 7/1996 Williams ..... 89/36.08

*Primary Examiner*—Stephen M. Johnson
*Attorney, Agent, or Firm*—Peter A. Taucher; David L. Kuhn

[57] ABSTRACT

A set of interior armor panels are removably installed in a passenger vehicle. At least one of the panels is a door armor panel covering a lower part of a door. Hooks on the door armor panel engage the door's sill, these hooks having ends inserted into the door through a window slot defined by the sill. Belts hold the door armor panel against the door. The belts are connected at one end to anchors on the inboard side of the door armor panel and the other ends of the belts have hooks closely fit to flanges at the periphery of the door. Buckles on the belts adjust their length. Additional armor panels are removably installed in the vehicle, the additional panels and the door armor panel together forming a ballistically continuous band of protective material within the vehicle's passenger compartment.

8 Claims, 4 Drawing Sheets

INTERIOR ARMOR FOR PASSENGER VEHICLES

GOVERNMENT USE

The invention described here may be made, used and licensed by or for the U.S. Government for governmental purposes without paying us any royalty.

BACKGROUND

Our invention relates to the armor structure used for vehicles that carry passengers or valuables. Many armored vehicles are standard production vehicles specially modified to accept armor panels. Often such vehicles are changed so drastically that they can not easily be resold for normal use, even if armor components are removed. Additionally, many armored cargo and passenger vehicles are conspicuous and attract attention because of their unusual character. In some cases, it is important that an armored vehicle be difficult to distinguish from normal vehicles.

SUMMARY OF THE INVENTION

In view of the above considerations, we have invented an inconspicuous interior armor construction which is removably installed in the passenger or cargo compartment of a vehicle. Our construction has a door armor panel attached to the inboard side of a vehicle door. Installing or removing the panel does not affect the door's structure. The panel has an outline similar to the part of the door below its window, and the panel covers that part. The panel has hooks by which it hangs on the door. The hooks fit onto the door's sill and ends of the hooks protrude into the door at a window slot in the sill. Also holding the armor panel onto the door are belt assemblies. These assemblies have hooks engaging anchors on the armor panel and peripheral flanges of the door. Instead of engaging peripheral flanges, the hooks can engage structural apertures in the door through which wire harnesses or door latch mechanisms pass. Buckles or like mechanisms on the belts are used to cinch the belts and thereby tighten the door armor panel against the door. Other removable armor panels are installed in the compartment so that the door armor panel and other panels form a ballistically continuous barrier about the compartment.

PRIOR ART

We are aware of hooks that fit into the window sills of vehicles to hang an armor panel on the outside of a vehicle. We are also aware of the use of cargo straps or turnbuckles to hold such hanging armor panels on the vehicle. However, we are unaware of any low-visability structure, such as ours, having armor panels removably placed on interior door panels so that the door panels are not damaged or permanently changed.

BRIEF DESCRIPTION OF THE DRAWINGS

FIG. 8 also shows the relative position of the connection between the belt and hook to the connection between the flange and main body of the door.

DETAILED DESCRIPTION

Figure 1:
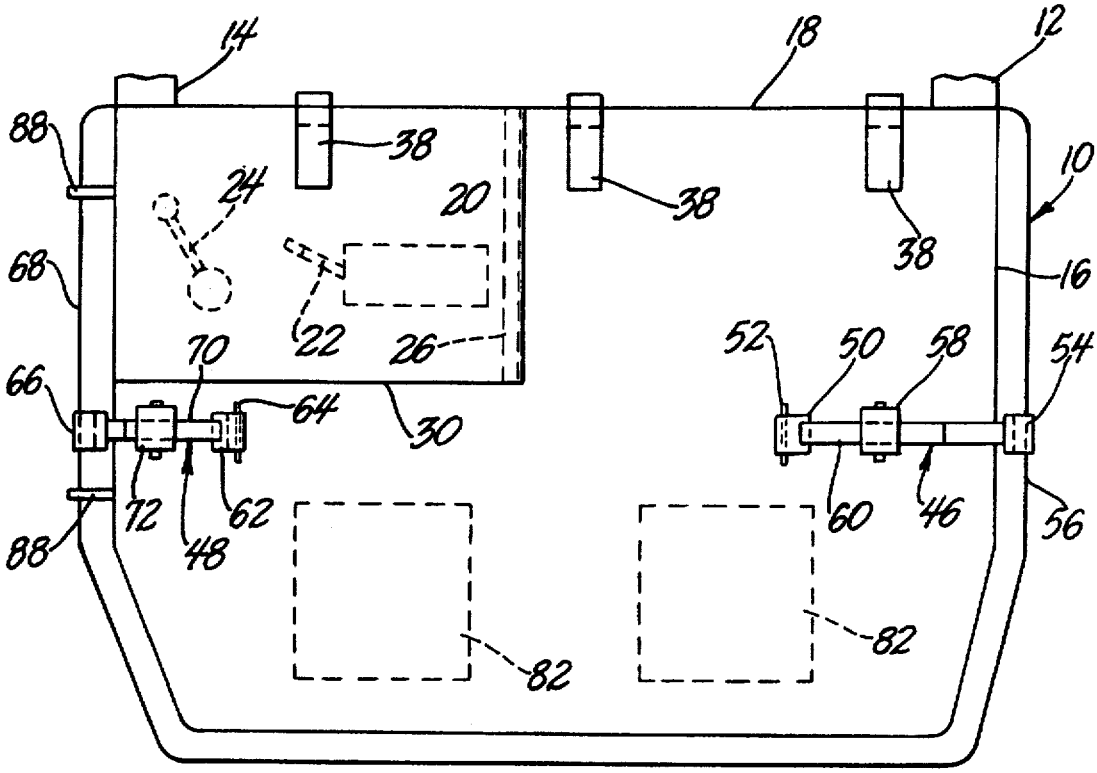
FIG. 1 is a side elevational view of a vehicle door with a door armor panel installed thereon.
Figure 2:
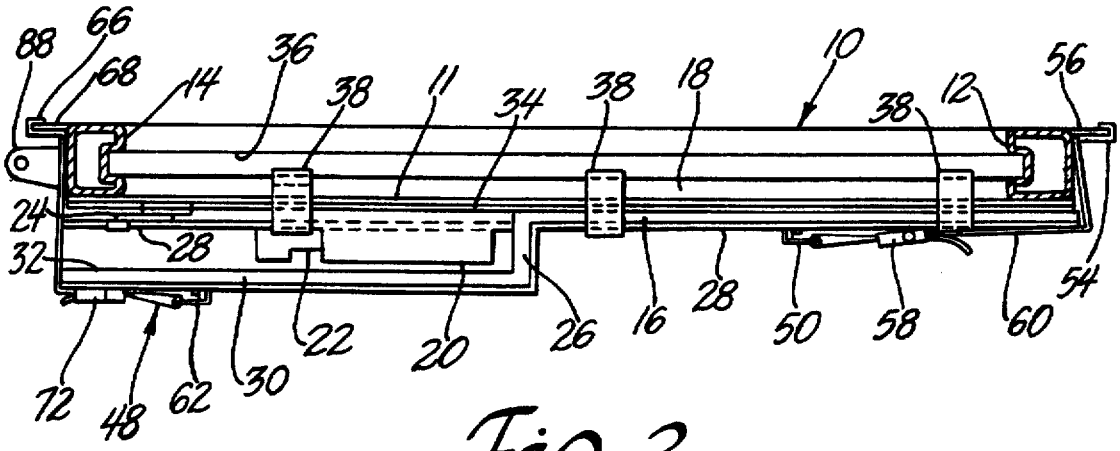
FIG. 2 is a plan view of the vehicle door and armor panel of FIG. 1.

In FIG. 1 is the lower portion of a typical passenger vehicle door 10 wherein portions 12 and 14 of a window frame for the door are shown. Door 10 has a conventional arm rest 20, latch handle 22 and window crank 24. As seen in FIG. 2, door sill 18 defines a slot 36 through which a glass window sheet passes when crank 24 turns. On the inboard side of the door is a conventional decorative trim panel 11.

Facing toward trim panel 11 is an armor panel 16 having generally the same outline as the lower portion of door 10, so that panel 16 covers the shape of door 10 from sill 18 to the door's bottom. It is contemplated that plate glass or plexiglass or like window, structure will provide ballistic protection above the level of the sill. On the outboard surface of armor panel 16 is felt sheet 34, which prevents the armor panel from scuffing the trim panel. Forming an inboard covering on armor panel 16 is a spall liner 28. Panel 16 has an offset 32 defined by end wall 26 and side wall 30, the offset covering arm rest 20, latch 22 and crank 24. The offset ballistically protects door 10 while allowing access to its arm rest, latch and crank.

Figure 5:
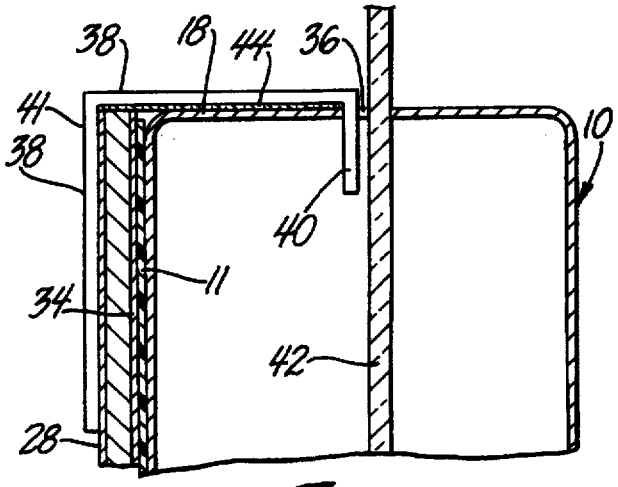
FIG. 5 is a partial sectional view of the door armor panel installed on the vehicle door.
Figure 5A:
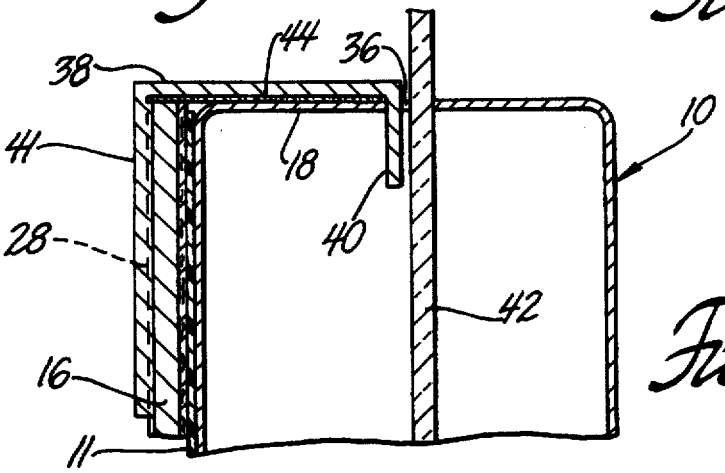
FIG. 5A is another partial sectional view of the door armor panel showing a hook's direct facial connection to the panel.

Armor panel 16 is attached to door 10 in such a way that door 10 need not be modified to accommodate the panel. When panel 16 is removed, door 10 will be in its original condition. The means to attach panel 16 to the door includes a plurality of hooks 38 fixed to panel 16 and engaging the door at sill 18. As seen in FIGS. 5 and 5A, hooks 38 are typically made from flat metal stock, and the hooks are typically welded directly to armor panel 16. Preferably, no portion of the spall liner lies between hooks 38 and armor panel 16. The direct attachment between a hook 38 and panel 16 is perhaps best seen in FIG. 5A, which includes a sectional view of hook 38.

Again as seen in FIGS. 5 and 5A, one end 40 of hook 38 extends into window slot 36 and fits between window sheet 42 and the edge of slot 36. The distance between end 40 and hook shank 41 can be such that hook 38 fits closely with the edge of sill 18 and panel 16. A layer 44 of felt or other material can be used to protect sill 18 from scratching or scuffing by hook 38.

The means to attach panel 16 to the door also includes adjustable belt assemblies 46 and 48 in FIGS. 1 and 2. These assemblies are shown as being approximately half way between the top and bottom of armor panel 16. However, they can also be the bottom third of panel 16, at the same height as pads 82. One end of belt assembly 46 has a hook 50 that fits into anchor 52 and another hook 54 that fits onto door flange 56. A flexible belt 60 attaches to hook 54, passes through conventional buckle 58, loops through hook 50 and returns through buckle 58. Buckle 58 adjusts the length and tightness of belt 60 in known fashion. One end of the other belt assembly 48 has a hook 62 that fits into anchor 64 and another hook 66 that fits onto door flange 68. A flexible belt 70 attaches to hook 66, passes through conventional buckle. 72, loops through hook 62 and returns through buckle 72.

Figure 8:
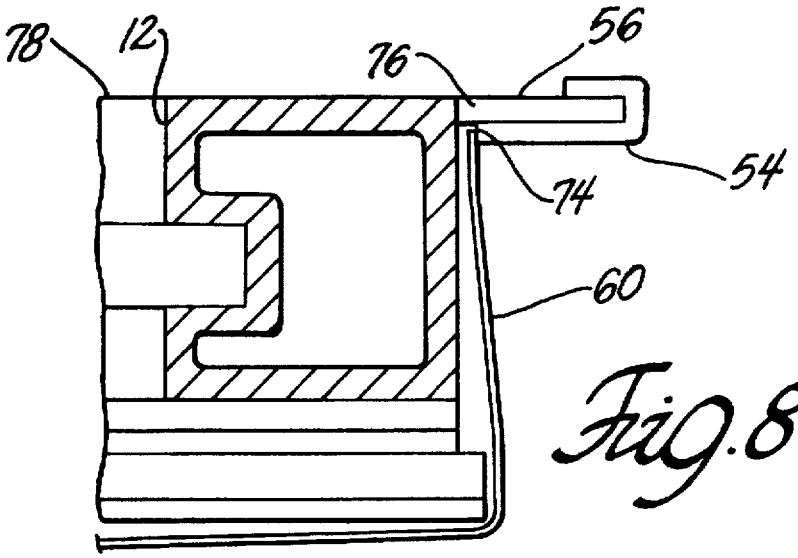
FIG. 8 is a detail view showing the engagement of a hook to the door flange.

As perhaps best seen in FIG. 8, hook 54 fits closely onto door flange 56. Also as shown in FIG. 8, it may be preferred that the point 74 where hook 54 attaches to belt 60 is next to zone 76, where flange 56 joins the main body 78 of the door. Such an arrangement reduces the tension on belt 60 when door 10 shuts to mate with door frame 80 (FIG. 3), at which time the portion of belt 60 near hook 54 will be squeezed between door 10 and frame 80. It will be understood that hook 66 can engage flange 68 in the same way that hook 54 engages flange 56.

Figure 9:
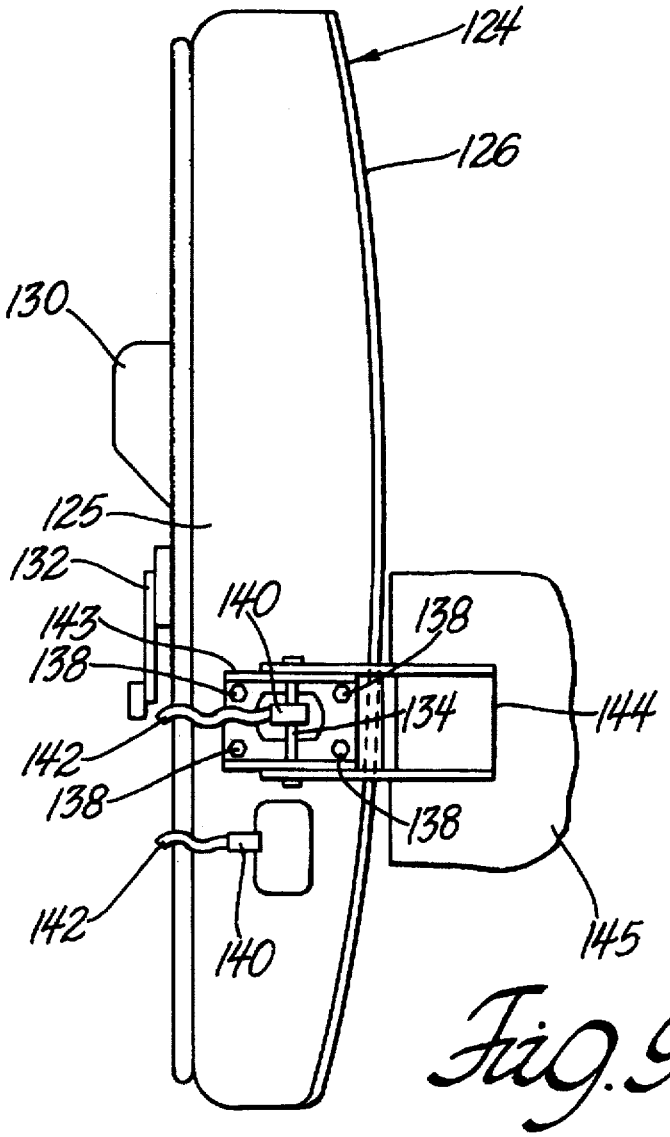
FIG. 9 is an end view of a door where hooks of a belt assembly attach to edges of apertures in the door.

Hooks 54 or 66 can engage a door in other attachment points besides flange 56, particularly at pre-existing structural apertures in ends of the door or at hinge pins. For example, the front end 125 of a door 124 is shown in FIG. 9 with apertures 136 defined therein. Aperture 136 allows a wire harness (not shown) to pass into door 124. On some vehicles, the door hinge assembly consists of a stamped sheet metal outer member 144 that is welded to the vehicle body structure 145, a stamped sheet metal inner member 143 that is attached to the door structure 124 with bolts 138, and a hinge pin 134 that connects members 143 and 144. Hooks 140, similar to hooks 56, can engage aperture 136 or hinge pin 134. Belts 142, similar to belt 60, are attached to hooks 140.

Figure 6:
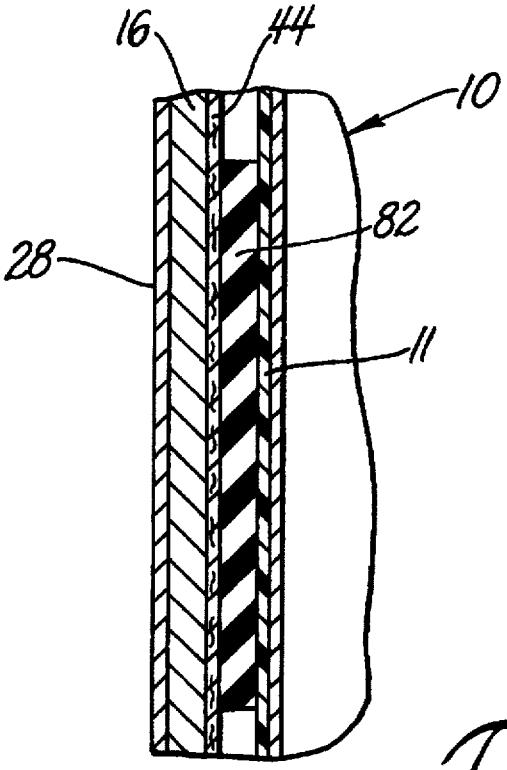
FIG. 6 is a sectional detail view showing a resilient pad disposed between the door and the door armor panel.

As seen in FIG. 1, there are a pair of flat pads 82 disposed on the outboard side of armor panel 16 and preferably at the bottom area of that panel. Pads 82 are typically made of fibrous material or rubber and are resiliently compressible. When door 10 shuts with frame 82, the tension on belts 60 and 70 compresses pads 82, allowing the belts the slack needed for assured door closure. As seen in FIG. 6, pads 82 are sandwiched between felt layer 44 on panel 16 and trim panel 11 on door 10.

Figure 3:
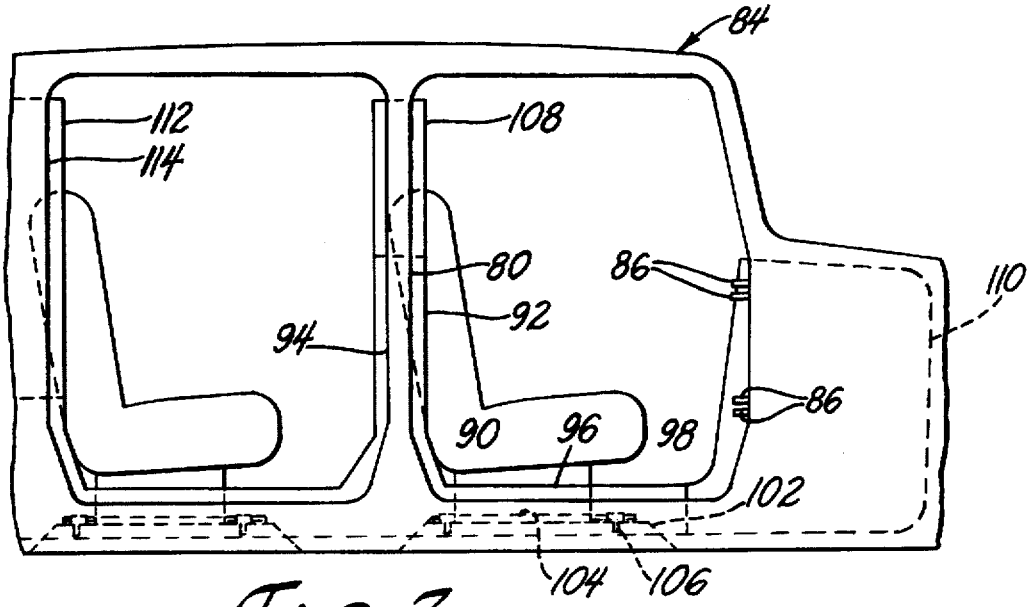
FIG. 3 is a partial side elevational view of a vehicle body with a set of armor panels installed therein.
Figure 4:
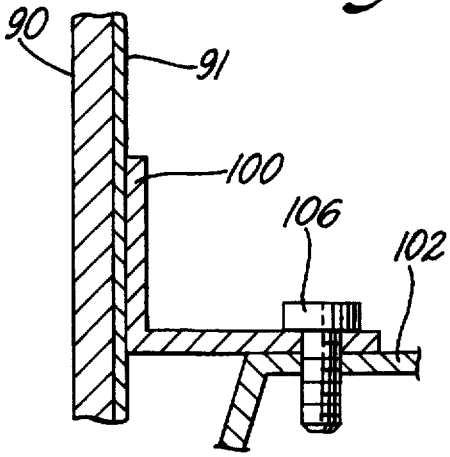
FIG. 4 is a sectional detail view showing an optional structure for fastening the door armor panel to the vehicle body.

The vehicle body 84 on which door 10 fits is shown in FIG. 3. The right front door frame 80 of body 84 has two pairs of conventional hinge members 86 which engage complimentary hinge members 88 of door 10. Body 84 is provided with additional armor panels which complement the door's armor panel 16. One additional armor panel is a generally T-shaped panel 90 having a vertical portion 92 along vehicle body pillar 94 and a horizontal portion 96 disposed inside body 84 along vehicle rocker panel 98. Panel 90 can merely rest on the floor of body 84 or can be affixed to body 84 as shown, by way of example, in FIG. 4. In that figure, panel 90 has a spall liner 91 and is affixed to angular bracket 100, which in turn is affixed to seat base 102 of the vehicle body floor by bolt 106. As seen in FIG. 3 bolt 106 can be one of the bolts holding seat rail 104 to seat base 102.

Returning to FIG. 3, another typical armor panel is an elongate vertical panel 108 which is connected to the top of vertical portion 92. Vertical panel 108 is typically affixed to the inboard side of body pillar 94 by the same fasteners (not shown) that affix the seat belt anchor (also not shown) to pillar 94. Another armor panel is a forward panel 110 fixed to horizontal portion 96 and protecting the lower front side of the vehicle passenger compartment. A rear side armor panel 112 is affixed to the aft portion of T-shaped armor panel 90 and extends along the rear edge of door frame 114. All of the aforementioned armor panels will be hidden or largely obscured when doors are on vehicle body 84 and the doors are shut.

Figure 7:
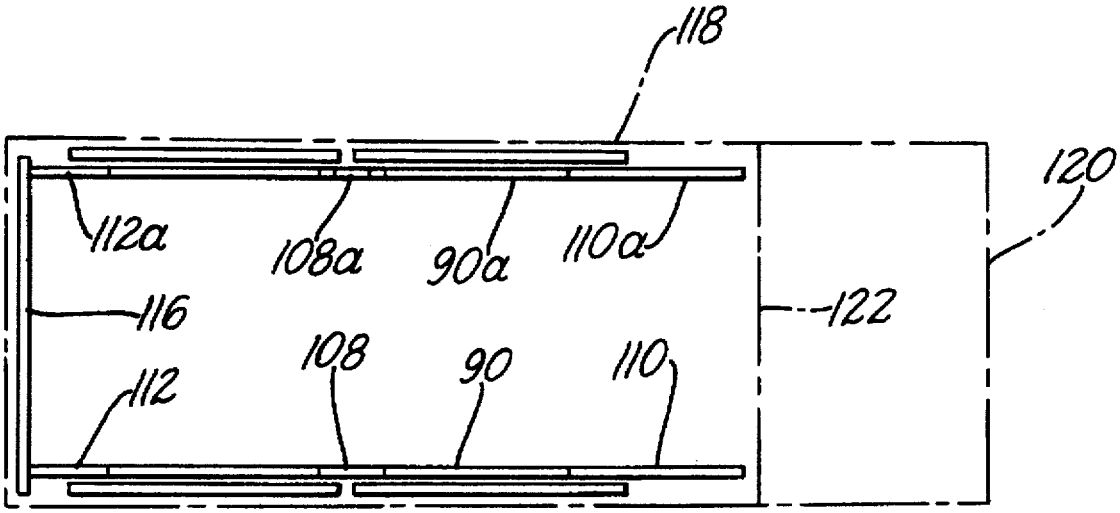
FIG. 7 is a plan view of a set of armor panels within the space envelope of a passenger compartment of a vehicle, the panels forming a continuous ballistic barrier about the compartment.

FIG. 7 shows how armor panels such as those just described are juxtaposed to form an effectively continuous ballistic barrier about the passenger compartment of an automobile. In that figure, the space envelope occupied by the vehicle's passenger compartment is represented by the rectangular dashed-line enclosure at 118. The vehicle's engine compartment is represented by the dashed-line enclosure at 120. Within passenger compartment 118, armor panels 110, 90, and 112 overlap to prevent entry therebetween into compartment 118 by projectiles. Armor panels **110*a*, 90*a* and 112*a* correspond respectively to panels 110, 90, and 112 and provide the same overlapping ballistic protection. Protection for the rear of compartment 118 is furnished by an armor panel 116 bolted or otherwise connected to armor panels 112 and 112*a***.

It is conceivable to place an armor panel at the interface 122 between the passenger and engine compartments. However, it is believed that such an armor panel is normally not needed because the engine components, dash board and instrument panel all provide ballistic protection from the forward direction.

We do not desire to be limited to the exact details of construction or method shown herein since obvious modifications will occur to those skilled in the relevant arts without departing from the spirit and scope of the following claims.

What is claimed is:

1. An armor panel construction removably fastened to a door of a vehicle, comprising:

an armor panel inside the vehicle covering a lower part of the door, the armor panel having an outline similar to the lower part of the door;

upper hooks at the top of the armor panel engaging a sill of the door;

an anchor on the armor panel;

an attachment point on the door;

a belt assembly holding the armor panel against the door;

an attachment member of the belt assembly engaging the attachment point;

means for connecting the belt assembly to the anchor;

a belt of the belt assembly to which the attachment member and the connecting means are fastened; and means on the belt assembly for adjusting the length of the belt.

2. The construction of claim 1 further comprising means for providing slack to the belt when the door closes.

3. The construction of claim 2 wherein the providing means is a resilient pad disposed between the armor panel and the door.

4. The construction of claim 1 wherein the attachment point is a flange of the door and the attaching means is flange hook fitting on the flange, the construction further comprising:

a zone where the flange attaches to a main body of the door;

a shank on the flange hook lying against an inboard side of the flange; and a connection between the belt and the shank, the connection being adjacent the zone.

5. The construction of claim 1 further including means in the armor panel for accessing a door latch handle and a window crank on the door, the accessing means being an offset having a wall inboard of the handle and crank.

6. A low-visibility armor panel construction removably attached to an inboard side of a door of a passenger vehicle but not permanently affecting structure of the door, the armor panel construction comprising:

an armor panel having an outline similar to a lower part of the door and covering the lower part;

upper hooks at the a top of the armor panel closely fitting a sill of the door, the upper hooks having ends inserted into the door through a window slot defined by the sill;

an anchor on the inboard side of the armor panel;

an attachment point on the door;

an adjustable belt assembly holding the armor panel against the door;

an attachment member of the belt assembly engaging the attachment point;

means for attaching the belt assembly to the anchor;

a belt of the belt assembly to which the attachment member and the attaching means are connected; and means on the belt for adjusting the length of the belt.

7. The construction of claim 6 further comprising means on the construction to prevent the construction from scuffing the door.

8. An interior armor construction removably installed in a passenger vehicle having a door, comprising:

a door armor panel covering a lower part of the door;

upper hooks at the a top of the door armor panel engaging a sill of the door;

an anchor on the inboard side of the door armor panel;

an attachment point on the door;

a belt assembly holding the door armor panel against the door;

an attachment member of the belt assembly engaging the attachment point;

means for attaching the belt assembly to the anchor;

a belt of the belt assembly to which the attachment member and the attaching means are connected;

means on the belt assembly to adjust the length of the belt;

a set of additional armor panels removably installed in the vehicle, the set and the door armor panel together forming a band of ballistically protective material about a passenger compartment of the vehicle.

* * * * *